United States Patent [19]

Hinterberger

[11] Patent Number: 4,472,612

[45] Date of Patent: Sep. 18, 1984

[54] ELECTRICAL SLIDE SWITCH

[75] Inventor: Leopold Hinterberger, Höhenkirchen, Fed. Rep. of Germany

[73] Assignee: Fa. Wilhelm Ruf KG, Munich, Fed. Rep. of Germany

[21] Appl. No.: 444,337

[22] Filed: Nov. 24, 1982

[30] Foreign Application Priority Data

Dec. 17, 1981 [DE] Fed. Rep. of Germany ..... 3150046

[51] Int. Cl.[3] ..... H01H 5/06

[52] U.S. Cl. ..... 200/67 PK; 200/67 A

[58] Field of Search ..... 200/67 A, 67 PK, DIG. 42

[56] References Cited

U.S. PATENT DOCUMENTS

| | | | |
|---|---|---|---|
| 1,810,931 | 6/1931 | Spahr | 200/67 A |
| 3,330,924 | 7/1967 | Larkin | 200/67 A |
| 3,967,081 | 6/1976 | Portmann et al. | 200/67 PK |
| 4,045,632 | 8/1977 | Pierrot | 200/67 PK |
| 4,347,415 | 8/1982 | Falchi | 200/67 PK |

FOREIGN PATENT DOCUMENTS

| | | | |
|---|---|---|---|
| 1085217 | 7/1960 | Fed. Rep. of Germany | 200/67 PK |
| 1935225 | 12/1971 | Fed. Rep. of Germany . | |
| 2341488 | 3/1975 | Fed. Rep. of Germany . | |
| 1114630 | 5/1968 | United Kingdom . | |

*Primary Examiner*—John W. Shepperd

*Attorney, Agent, or Firm*—Cushman, Darby & Cushman

[57] ABSTRACT

An electrical slide switch comprising spring-action mechanics (5) overcomes the problems of fused contacts (3,6) caused by high starting currents by the provision of disconnecting mechanics (2,9) which positively separate the rocking arm (3) from its associated contact (6) as the switch is turned off. Preferably the disconnecting mechanics does not act on the rocking arm until shortly before the switch-off end position of the slide switch is reached. The disconnecting mechanics preferably consists of an insulating material lever (9) which is pivoted by a pin (11) of the slide member (2) against the force of a spring arm (22), the insulating material lever (9) having a lug (12) which protrudes into the path of pivoting movement of the rocking arm to positively move the same.

6 Claims, 41 Drawing Figures

ELECTRICAL SLIDE SWITCH

The instant invention relates to an electrical slide switch, comprising at least one rocking arm which is pivotable by a slide member and spring- or snap-action mechanics and touches a contact at least in its one pivoting end position.

Such switches, including snap-action mechanics are known in general and used preferably for switching on and off electrical instruments or appliances in which high current peaks are liable to occur upon switch-on, for instance in color television sets. The snap- or spring-action mechanics warrants quick movement of the rocking arm as soon as the slide member has passed a "dead center".

In this manner chattering of the switches is avoided and, in addition, any arcs which may be caused by the very rapid movement of the switch are quickly extinguished.

And yet the high starting currents of such switches cause heating and, as a consequence, fusing of the associated contacts. Then the switch can no longer be opened and must be replaced. Usually the cost of labor this involves is by no means commensurate with the value of the replaced switch.

These problems are to be overcome by the instant invention.

It is an object of the invention to improve the slide switch of the kind specified initially such that the normal switching function is upheld even with fused contacts.

This object is met, in accordance with the invention, by disconnecting mechanics which positively (mechanically) separate the rocking arm from its associated contact as the switch is opened.

Any fusion between the rocking arm and its associated contact is torn thereby so that the spring-action mechanics will have a chance to move the rocking arm into the open position of the switch. Certain damaging of the surfaces of the contacts which touch each other is quite acceptable without any noticeable effect upon the functioning of the switch during subsequent switching procedures.

In a preferred embodiment of the invention the disconnecting mechanics is embodied by a pivotable lever of insulating material adapted to be pivoted by the slide member. When moving the slide member in the direction of opening the switch the rocking arm is pivoted such that it acts in the sense of effecting a separation between the rocking arm and its associated contact.

Preferably the arrangement of the insulating material lever and the rocking arm is such that the insulating material lever will not act on the rocking arm until shortly before the limit position of the slide member is reached.

In accordance with another preferred embodiment of the invention the insulating material lever is biased resiliently in one direction in which it is out of engagement with the rocking arm. This facilitates actuation of the insulating material lever as it must take place in one direction only.

In a structurally preferred embodiment of the invention the insulating material lever is supported at a housing closure plate, a lug or nose protruding into the path of pivoting movement of the rocking arm being adapted to be moved to touch the rocking arm, and a pin projecting out of the slide member being pushed against an abutment face of the insulating lever to rock the same when the slide member is moved. The selection of the spacing between the abutment face and the lug of the slide member thus guarantees in very simple manner that the insulating material lever will not act on the rocking arm until just before the end position of the slide member is reached.

The spring action of the insulating material lever is obtained in particularly simple manner by forming the insulating material lever integrally with a spring arm supported against a support face of the housing closure plate.

An especially simple support of the insulating material lever is obtained if the latter is held in a recess of the housing closure plate on a pivot bearing embodied by a bolt, the lug being the only thing which protrudes out of the recess. In this context it is convenient to design the end of the bolt as a calking pin which permits easy, safe, and durable fastening of the insulating material lever at the housing closure plate.

Still better support of the insulating material lever is obtained by providing, in addition to the bolt, a circular recess in the housing closure plate to support the outside of the insulating material lever.

A two- or more pole design of the slide switch is desirable for various applications. In this event a separate insulating material lever is coordinated with each rocking arm.

The invention will be described further, by way of example, with reference to the accompanying drawings, in which:

In the various figures the same reference numerals are used to designate identical parts. If there are several identical parts, they are marked by the reference numeral and an additional ′ to differentiate them.

FIG. 1 shows an embodiment of a two-pole slide switch in which the invention is realized. For better understanding of the functioning of the slide switch and of the spring-action mechanics the housing is shown open and the disconnecting mechanics is not to be seen.

Figure 1:
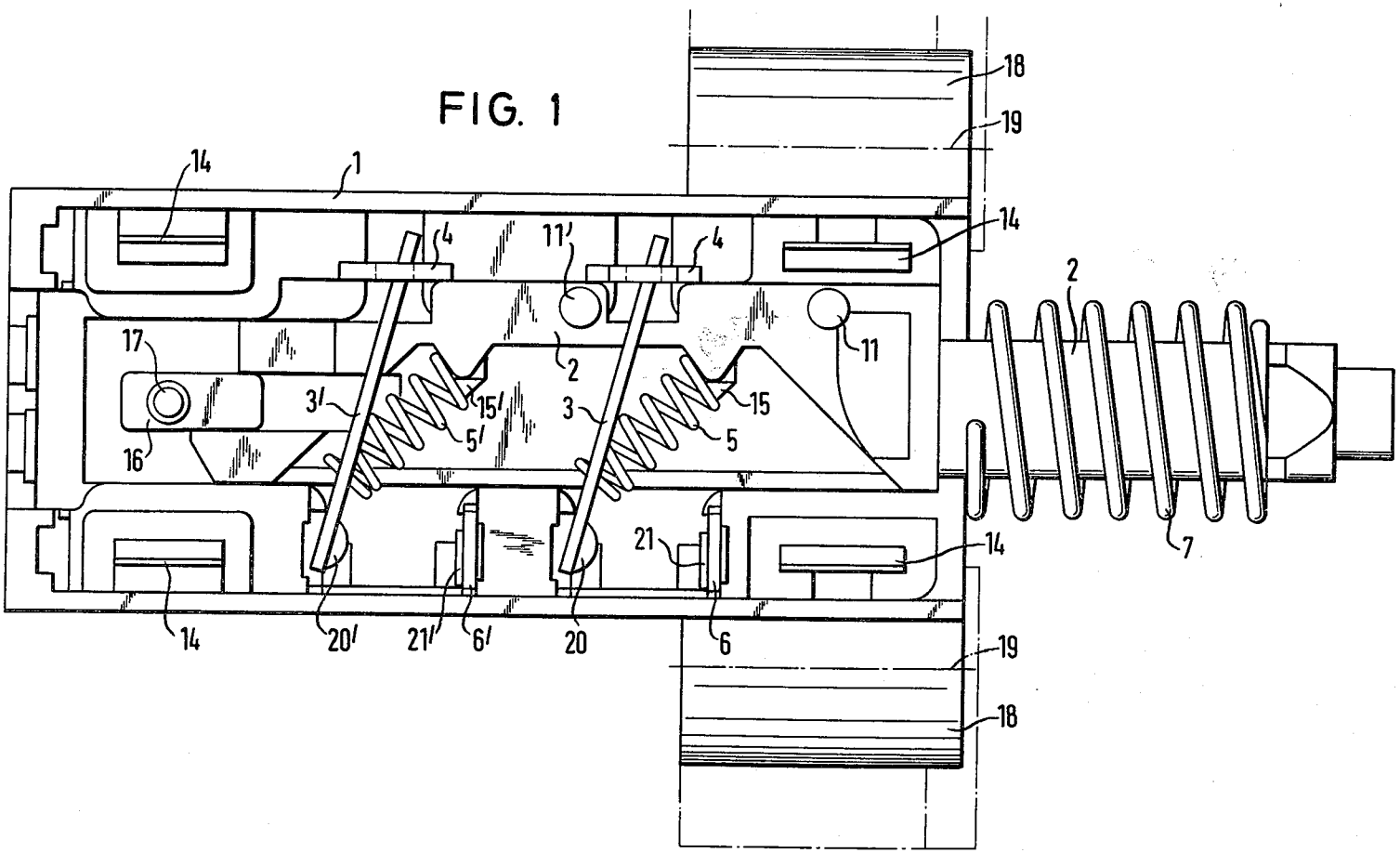
FIG. 1 is a top plan view of a slide switch upon removal of the closure plate.
Figure 36:
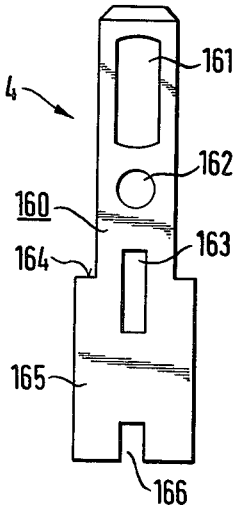
FIG. 36 is a top plan view of a support eye.
Figure 37:
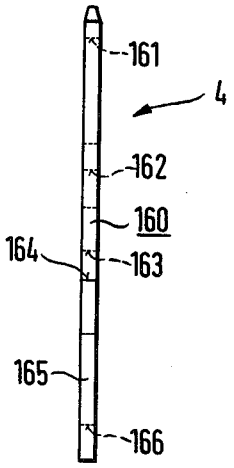
FIG. 37 is a side elevational view of the support eye shown in FIG. 36.

In a housing 1 a slide member 2 is guided for rectilinear displacement, its one end projecting out of the housing. Inside the housing two rocking arms 3, 3′ are disposed essentially transversely of the longitudinal extension (cf. FIGS. 34 and 35). Each rocking arm is pivotably supported in a support eye 4, 4′ (FIGS. 36 and 37). The support eyes 4 and 4′ are fixed laterally in corresponding recesses formed in the housing 1. The rocking arms 3 and 3′ are pressed into their pivot end positions by helical springs 5 and 5′, respectively. One end each of the helical springs is supported on a projection 150 (FIG. 34) of the rocking arm, while the other end each is supported on a projection 15 or 15′ resp. of the slide member. In the position shown the switch is open, i.e. contact faces 20 and 20′ of the rocking arms 3 and 3′ are remote from contact faces 21 and 21′ of associated contact eyes 6 and 6′, respectively. The contact eyes 6 and 6′ also are fixed in suitable recesses of the housing 1 and are located at the side of the housing opposite the support eyes 4. When the slide member 1 is moved to the left, as seen in FIG. 1, this will bias the springs 5, at the same time, moving their ends remote from the rocking arms to the left. The ends of the springs facing the contact arms at first will remain stationary. As soon as the projections 15 and thus the ends of the springs remote from the rocking arms have been moved beyond a certain point, the springs will press the rocking arms to the right, as seen in FIG. 1, so that the contact face of the rocking arms will "snap" in the direction of the contact eyes 6 and 6′, respectively. This will cause the contact faces 20 and 20′ to touch the contact faces 21 and 21′, respectively.

Figure 2:
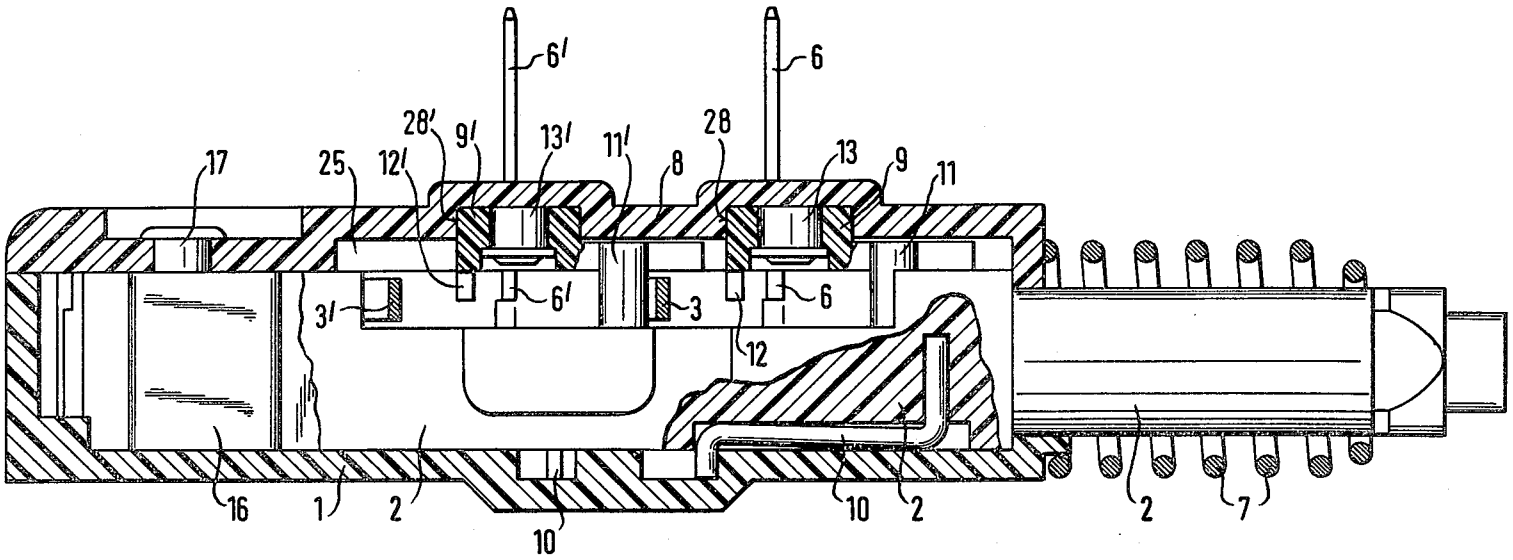
FIG. 2 is a sectional elevation of the switch shown in FIG. 1 with the closure plate attached.

Thereupon the slide member will be held in switched-on position of the switch by means of catch mechanics 10 (FIG. 2). To open the switch, the slide member first is pressed a little further to the left in FIG. 1, whereby the catch mechanics becomes released again. Then the slide member is pulled to the right in FIG. 1 under the action of the spring 7 which, on the one hand, is supported on the housing 1 and, on the other hand, on the slide member, thereby carrying out a switch-over process in analogous manner.

Lateral fixing arms 18 each formed with the a screw opening 19 are provided at the housing.

Furthermore, the housing is provided with upwardly projecting locking pawls 14 serving to secure a housing closure plate 8 (FIG. 2).

A carrier member 16 projecting from the bottom of the housing is provided in addition for guiding the slide member 2. A pin 17 projects from this carrier member and serves to center and fix the housing closure plate.

Further details of the housing will be explained with reference to FIGS. 12 to 18.

In the sectional elevation of FIG. 2 additional details of the housing closure plate 18 may be seen as well as the disconnecting mechanics and the spring-action mechanics.

An essential element of the disconnecting mechanics is an "insulating material lever" 9 pivotably supported on a bolt 13 of the housing closure plate 8. A lug 12 of the insulating material lever 9 projects into the range of pivoting movement of the rocking arm 3. The pin 11 projecting upwardly from the slide member 2 is pushed against an abutment face of the insulating material lever to pivot the same. Hereby the lug 12 is moved so as to touch the rocking arm 3, pressing the same out of its closing position. FIG. 2 shows the switch in open position in which the rocking arm 3 is remote from the lug 12. The insulating material lever 9 is received in a recess 25 of the housing closure plate 8, the lug 12 alone projecting beyond the outline of the housing closure plate 8.

For reasons of clarity the insulating material lever 9 is shown partly cut off so as to make the pin 11 better visible.

All the details described above, of course, also apply to items marked with reference numeral and ′.

Figure 3:
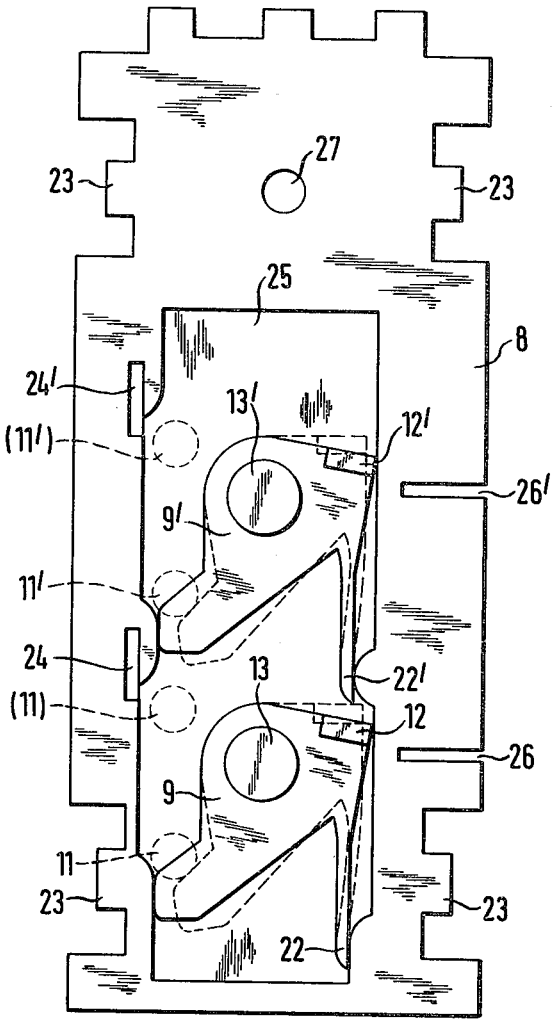
FIG. 3 is a plan view of the inside of the closure plate with insulating material levers inserted.
Figure 4:
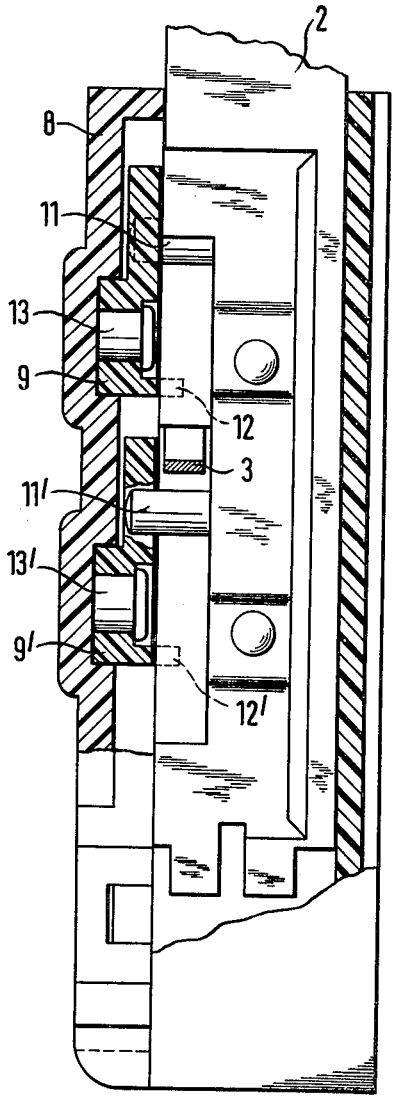
FIG. 4 is a side elevational view, partly in section, of the switch similar to FIG. 2.
Figure 5:
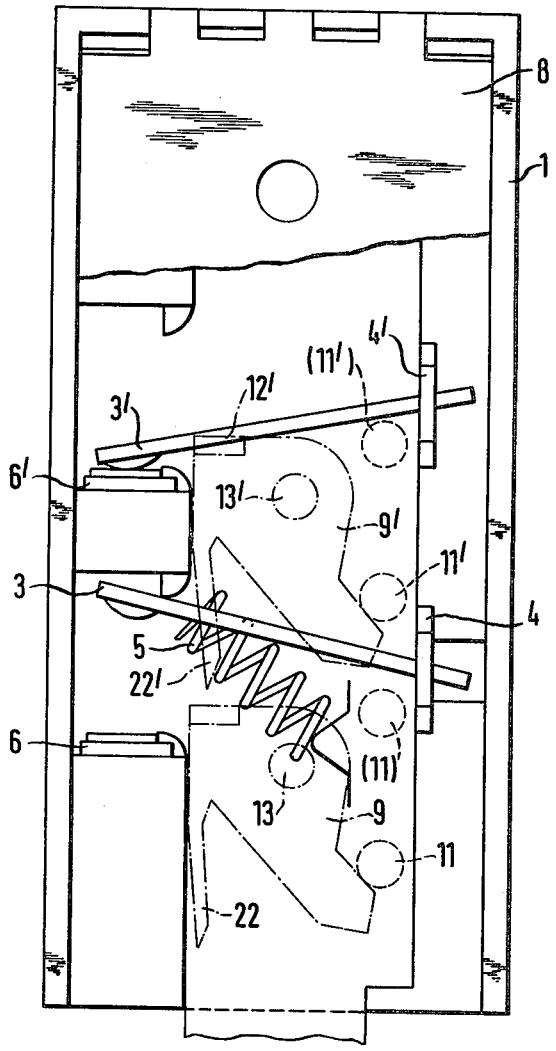
FIG. 5 is a diagrammatic top plan view of the switch with the closure plate attached, showing one contact already open, while the other one is still closed.

The mode of operation of the disconnecting mechanics will be recognized more clearly from FIGS. 3 to 5.

FIG. 3 is a plan view of the inside of the housing closure plate with insulating material levers inserted. The insulating material levers 9 and 9′ are supported on bolts 13 and 13′, respectively, in a recess 28 of the housing closure plate. The inoperative position of the insulating material levers is shown in continuous lines, whereas their deflected position caused by the pins 11 and 11′, respectively, is shown in discontinuous lines.

Reference numerals 24 and 24′ designate rectangular openings through which the support eyes 4 and 4′, respectively, project out of the housing or housing closure plate 8. The same applies to the openings 26 and 26' with respect to the contact eyes 6 and 6'.

Also to be seen are stop protrusions 23 with which the locking pawls 14 of the housing may become engaged.

As may be taken from FIG. 3, the insulating material lever 9 and 9', respectively, is formed in one piece with a spring arm 22 or 22', the spring arms being supported on support faces of the sidewalls of the recess 28.

The lugs 12 and 12' of the insulating levers 9 and 9' project upwardly from the plane of the drawing of FIG. 3. Furthermore, the pins 11 and 11' are to be seen in their two limit positions, the position of the pins in switched-on condition being characterized by their reference numerals placed in parentheses. Thus it may be recognized that in their one limit position the pins 11 and 11', respectively, press against a lug of the insulating material levers to pivot the same against the force of the spring arm 22 or 22'. This will cause the insulating lever to adopt the position shown in discontinuous lines, pivoting above all also the lugs 12 and 12', respectively.

FIG. 3 further shows an opening 27 through which the pin 17 passes through the housing closure plate.

FIG. 4 is a diagrammatic side elevational view showing a complete insulating material lever 9 in contrast to FIG. 2, whereas the other insulating material lever 9' is shown partly cut for better illustration of the position of the pin 11'.

FIG. 5 is a diagrammatic top plan view of the switch also indicating the position of the insulating material levers 9 and 9'. The rocking arm 3 has been opened by the spring 5, i.e. it is spaced from the contact eye 6, whereas the rocking arm 3' still is in touch with the contact eye 6'. In practice, of course, such a position cannot occur as the lug 12' of the insulating material lever 9' in this position already would have pressed away the rocking arm 3'. The technically incorrect presentation of FIG. 5 essentially serves to demonstrate to which extent the lug of the insulating material lever moves the rocking arm. Also to be recognized clearly is the rather long path of movement to be passed by the pins 11 and 11' before the disconnecting mechanics, i.e. the lug 12 of the insulating material lever will come to act on the rocking arm 3. This guarantees that the disconnecting mechanics begins to act on the rocking arm toward the end of the path of displacement only of the slide member 2 so that the spring-action mechanics already will have been fully biased in the direction of opening the switch.

FIGS. 6 to 11 are different views of the housing closure plate 8.

Figure 6:
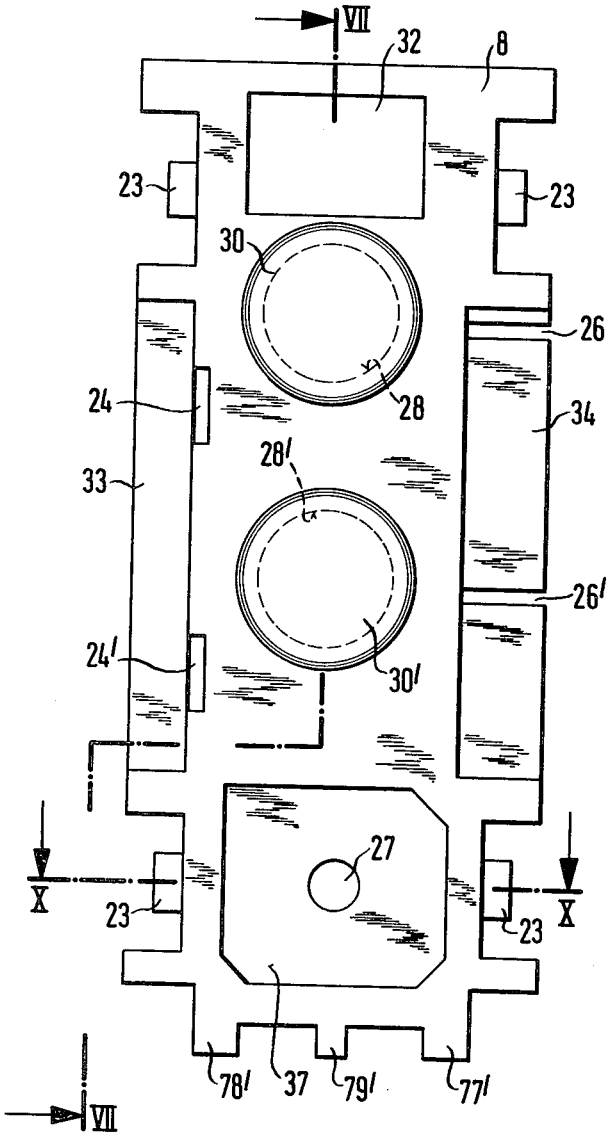
FIG. 6 is a plan view of the outside of the closure plate.
Figure 7:
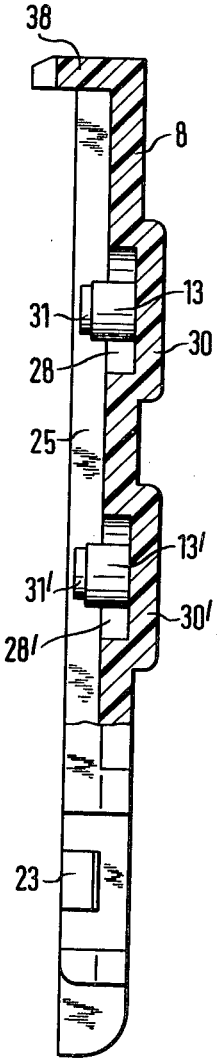
FIG. 7 is a sectional view along line VII—VII in FIG. 6.
Figure 8:
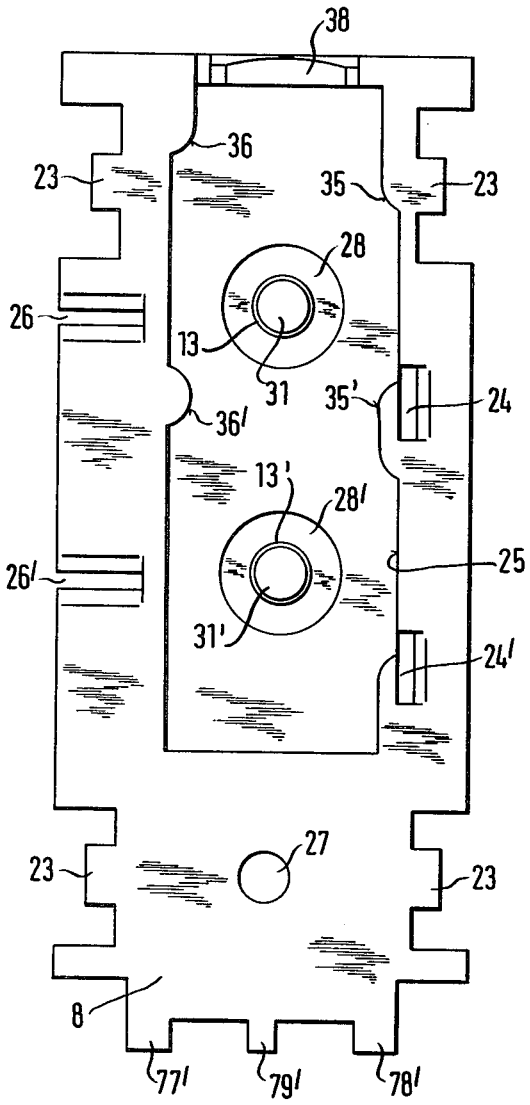
FIG. 8 is a plan view of the inside of the closure plate.
Figure 9:
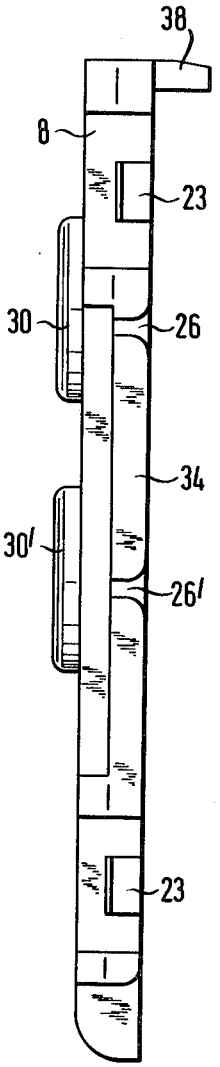
FIG. 9 is a side elevational view of the closure plate.

The two top plan views of FIGS. 6 and 8 show that the housing closure plate 8 essentially has a rectangular basic surface area interrupted by some projections and recesses. These projections and recesses, on the one hand, serve as catch means to lock the housing and, on the other hand, as passages or guide means for the contact and support eyes.

As may be gathered from FIGS. 6 to 9, the housing closure plate comprises outwardly directed circular projections 30 and 30' on its outside and corresponding recesses 28 and 28' at its inside, the bolts 13 and 13' being fixed in the centers of these recesses. The insulating material levers are pivotably supported on these bolts, being guided additionally at the sidewalls of the recess 28.

The bolts 13 and 13' are provided at their ends projecting into the interior of the switch with calking pins 31 and 31' which may be deformed permanently to retain the insulating material levers, as may be taken, for instance, from FIGS. 2 and 4.

At its side facing the housing, the housing closure plate 8 further comprises a recess 25 which is substantially rectangular. The essential part of the insulating material levers 9 and 9' each is disposed within this recess 25, lateral projections 35, 36 and 35', 36', respectively, serving as support faces for the insulating material levers. Specifically, the projections 36 and 36' serve as support faces for the spring arms 22 and 22', while the projections 35 and 35' serve as end stops for the arms 172 (FIG. 38) of the insulating material levers. As may be taken from FIG. 8, these projections are formed at sidewalls of the recess 25.

Lateral edges 33 and 34 of the housing closure plate 8 are lowered a little in the central range of their upper side so that along these edges the housing closure plate has a smaller cross section of material.

In the range of these edges openings 24, 24' and 26, 26' are formed for the contact or support eyes, respectively. As may be seen particularly in FIGS. 8 and 9, the inwardly directed edges of these openings 24, 24' and 26, 26' are rounded to facilitate the insertion of the eyes in question.

At its side facing the housing, the housing closure plate additionally comprises a guide member 38 at one end (cf. FIG. 11) adapted to the form of the slide member.

Figure 10:
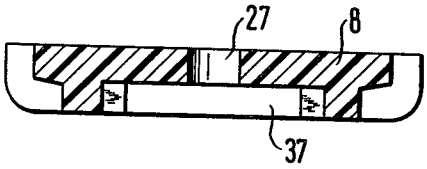
FIG. 10 is a sectional view of the closure plate along line X—X in FIG. 6.
Figure 11:
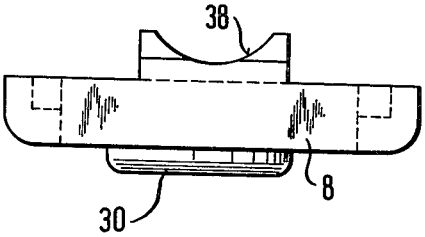
FIG. 11 is a plan view of a front end face of the closure plate.

The opening 27 for pin 17 is shown especially clearly in FIG. 10. Likewise shown is a recess 37 into which the carrier member 16 of the housing projects.

FIGS. 12 to 18 show the housing of the switch.

The housing 1 substantially has the shape of a parallelepiped, being defined by a bottom 40, two sidewalls 41, and a front and rear end wall 42 and 43, respectively. It is open at the top to be closed by the housing closure plate 8. The two fixing arms 18 project laterally from the sidewalls 41 in the area of one end of the housing. A plurality of projections or raised portions are formed at the sidewalls 41 and/or the bottom 40 to help guide the slide member, retain the support and contact eyes and support or fix the housing closure plate, respectively. Furthermore, a recess for the catch mechanics 10 is opened in the bottom 40 of the housing 1 and will be explained in greater detail with reference to FIG. 24.

The discontinuous lines 61 show the lateral guidance of the slide member. In addition wall 43 comprises a recess 44 adapted to the shape of the slide member. The individual guide means 45, 46, 49, 62, 70, 69 each are elevations which project from the bottom 40 of the housing and are connected to the adjacent sidewall 41 by webs, and have smooth surfaces at the side facing the center of the housing.

The guide surfaces 45, 46, 69, and 70 available at the four corners of the housing enclose the locking pawls 14 and extend upwardly from the bottom 40 of the housing almost to the level of the sidewalls 41. They end just so far under the upper edge of the sidewalls that the housing closure plate, when inserted, will be flush with the sidewalls of the housing. The same applies to the central guide surface areas 49 and 62. The walls of the webs of the guide faces directed forwardly and rearwardly, respectively, are provided with recesses 54, 55 serving to receive the contact eyes 6. It may be seen that further contact eyes could be introduced into further recesses provided, but not marked with reference numerals.

The sidewall 41 is connected to the bottom 40 of the housing by short reinforcement ribs 63, 64, 65, 66.

The webs of the guide surfaces in addition are provided with stops 56, 57, 58, 59 against which the rocking arms abut in their respective limit positions.

Webs at the guide surfaces 46, 62, 69 of the other side also are provided with recesses 51 and 52 in which the support eyes 4 are retained. The rocking arms in turn are pivotably held by these support eyes, the edges of the guide surfaces 46, 62, and 69 being rounded in the area of the recesses 51 and 52, respectively, so as to guarantee a sufficiently great pivot range of the rocking arms. The recesses 51 and 52 each are of T shape, reaching as far as the sidewall 41 so as to permit free pivoting movement of the end of the rocking arms extending toward the sidewall.

In the embodiment shown the guide surfaces 46, 62, and 69 do not project much above the bottom 40 of the housing, whereas the webs 48, 50, 53 leading up to them extend in upward direction almost up to the edge of the sidewall 41.

Further rectangular openings 67 and 68 are shown in the bottom 40, extending between the respective sidewall 41 and the locking pawls 14.

Figure 13:
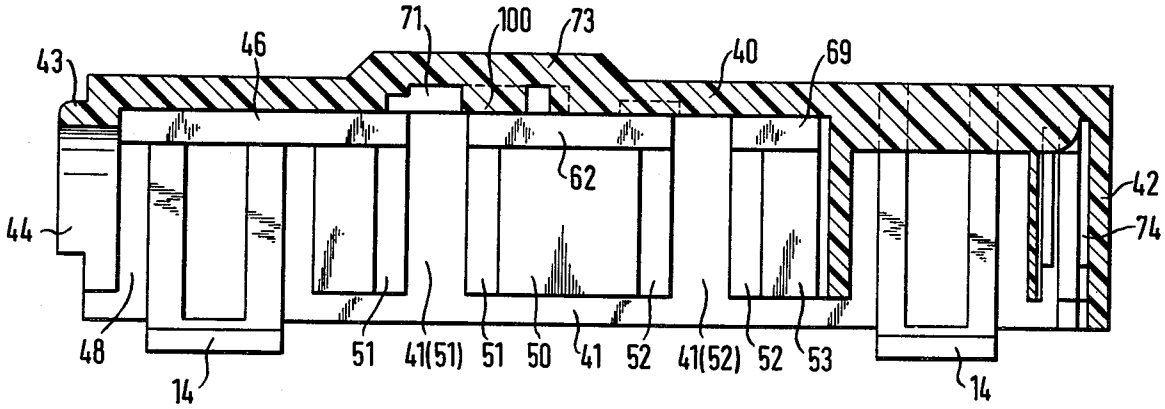
FIG. 13 is a sectional view along line XIII—XIII in FIG. 12.

The sectional view of FIG. 13 shows that a projection 73 is provided at the bottom 40 of the housing and formed in its interior with a recess 71 for the catch mechanics. Also shown is a projection 100 extending toward the interior of the housing and having a configuration shown in detail in FIG. 24. FIG. 13 further shows the individual webs 48, 50, 53 and the recesses 51 and 52. Reference numeral 74 designates another opening provided in the front end wall 42 for possible further contacts. FIG. 13 further clearly shows that the vertical leg of the T-shaped recess 51 reaches as far as the sidewall 41. It may also be seen that the guide surfaces 46, 62, and 69 project only a little above the bottom 40 of the housing.

Figure 14:
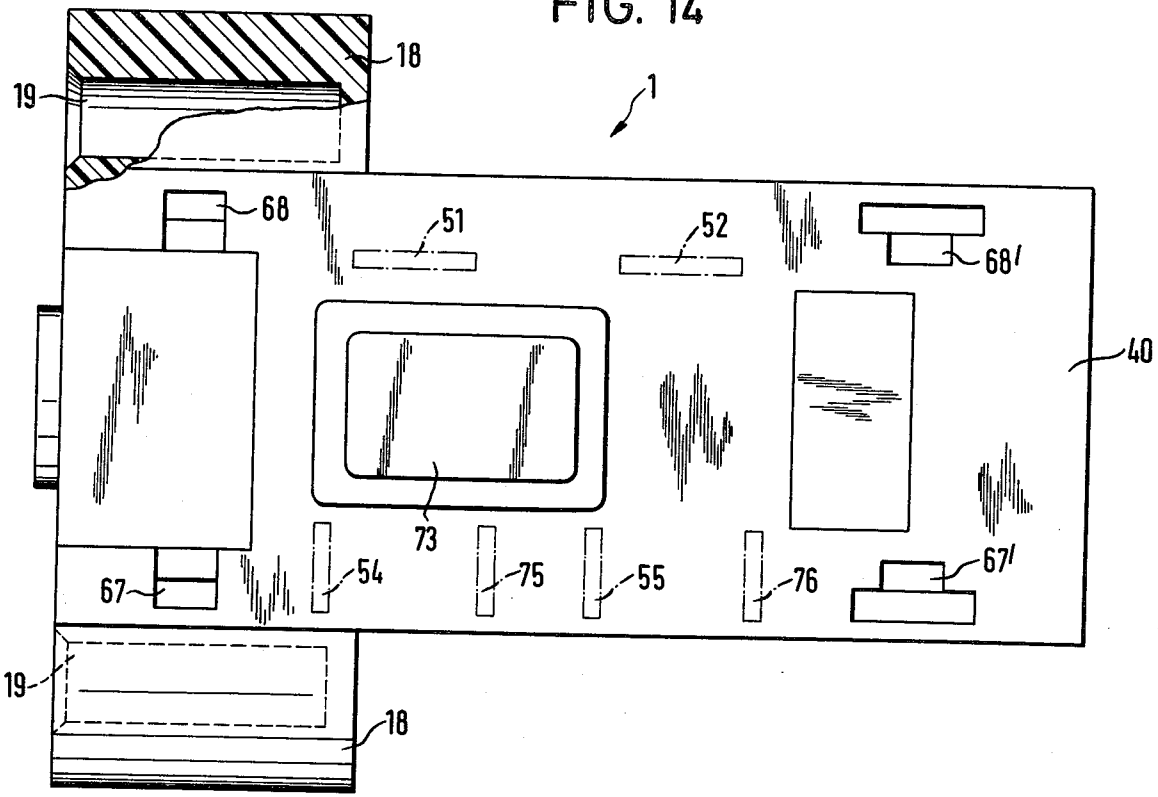
FIG. 14 is a plan view of the underside of the housing.

The view of FIG. 14, looking at the underside of the housing, shows the relative positions of the recesses 51, 52, 54, 55 which retain the individual eyes. Also shown are recesses 75 and 76 into which the further eyes mentioned above may be introduced, for example, to produce a change-over switch.

Finally, FIG. 14 shows the fixing arms 18 in greater detail with their screw or fastening openings 19.

Figure 15:
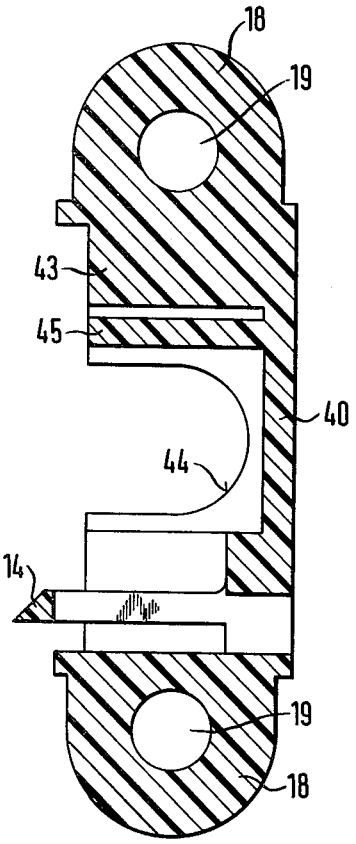
FIG. 15 is a sectional view along line XV—XV in FIG. 12.
Figure 16:
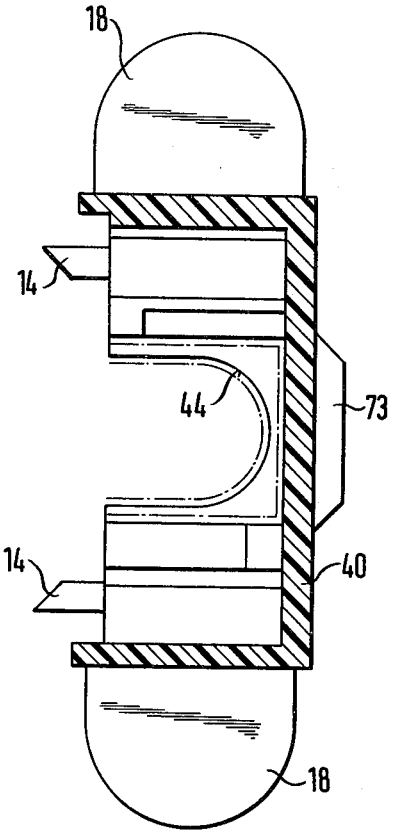
FIG. 16 is a sectional view along line XVI—XVI in FIG. 12.

The two sectional elevations of FIGS. 15 and 16 show the position of the recess 44 through which the slide member may exit from the front end wall 43 of the housing. Also the length of the locking pawls 14 may be recognized more clearly, specifically the fact that they project a little out of the housing.

Figure 17:
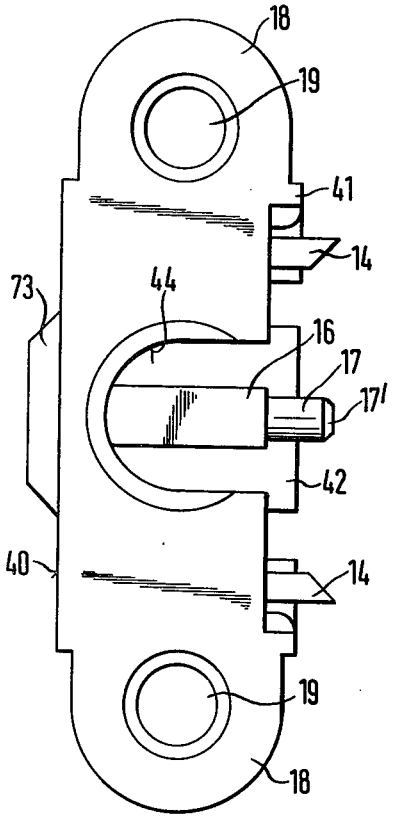
FIG. 17 is a view of the front end face of the housing from which part of the slide member projects.

FIG. 17 is a more distinct presentation of the arrangement of the carrier member 16 and of the pin 17. At its upper end the pin 17 carries a calking pin 17' which projects through the opening 27 of the housing closure plate and by means of which this plate may be connected firmly to the housing.

Figure 18:
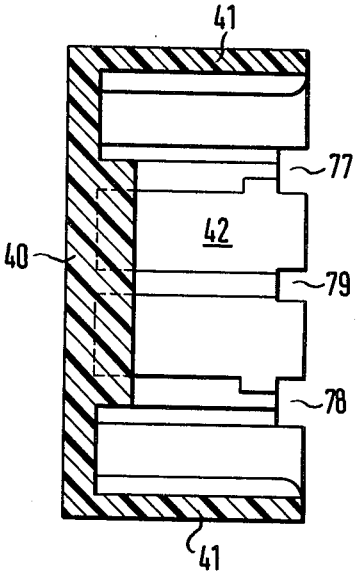
FIG. 18 is a sectional view along line XVIII—XVIII in FIG. 12.

FIG. 18 shows a plurality of recesses 77, 78, and 79 in the front end wall 42 of the housing receiving the individual projections 77', 78', and 79' (FIG. 8) of the housing closure plate 8, whereby the latter is centered with respect to the housing.

FIGS. 19 to 31 show the slide member 2 in greater detail.

It may be said in general that the slide member consists of three sections, one of which is always within the housing, while the second one passes through the front end wall of the housing. The third section always remains outside of the housing, serving to hold a pressure key.

This third section 81 is of cylindrical or rectangular or square cross section. In the embodiment shown it comprises two circumferential grooves which serve for the fixing of a pressure key (not shown).

The second section passing through the front end wall of the housing will be called a plunger 82. It may also have a cylindrical or rectangular cross section. At its end remote from the housing it has a circumferential groove 91 which serves for the fixing of the spring 7 (FIG. 1). At its other end the plunger merges into the first section which has a slightly larger cross section than the plunger 82, thereby forming a wall 90 on which the sping 7 may be supported during assembly. When the switch is assembled, this wall 90 will also be located inside the housing, thus serving as a stop to limit the path of the slide member as it is pushed against the wall 42 (FIG. 12) of the housing.

The first section located within the housing substantially consists of a rectangular plate 83 formed integrally with various elevations. At its end remote from the plunger 82 the plate 83 is formed with a recess 86 having vertically upwardly projecting elevations 85 and 89, respectively, the width of the recess 86 being adapted to the width of the carrier member 16 of the housing so that the slide member will be guided on the carrier member 16 through the recess 86.

At one lateral edge of the plate 83 the elevation 84 projects vertically substantially over the entire length of the plate 83. The elevation 84 is formed perpendicularly with ribs 80 and 80' extending parallel to the plate 83 and supporting lugs 15 and 15', respectively, for the springs 5 and 5', respectively.

The edge remote from the plate 83 of elevation 84 terminates below the profile of the wall 90. Two elevations 87 and 88 project laterally outwardly from the elevation 84 to serve for fixing of the pins 11 and 11', respectively.

Figure 19:
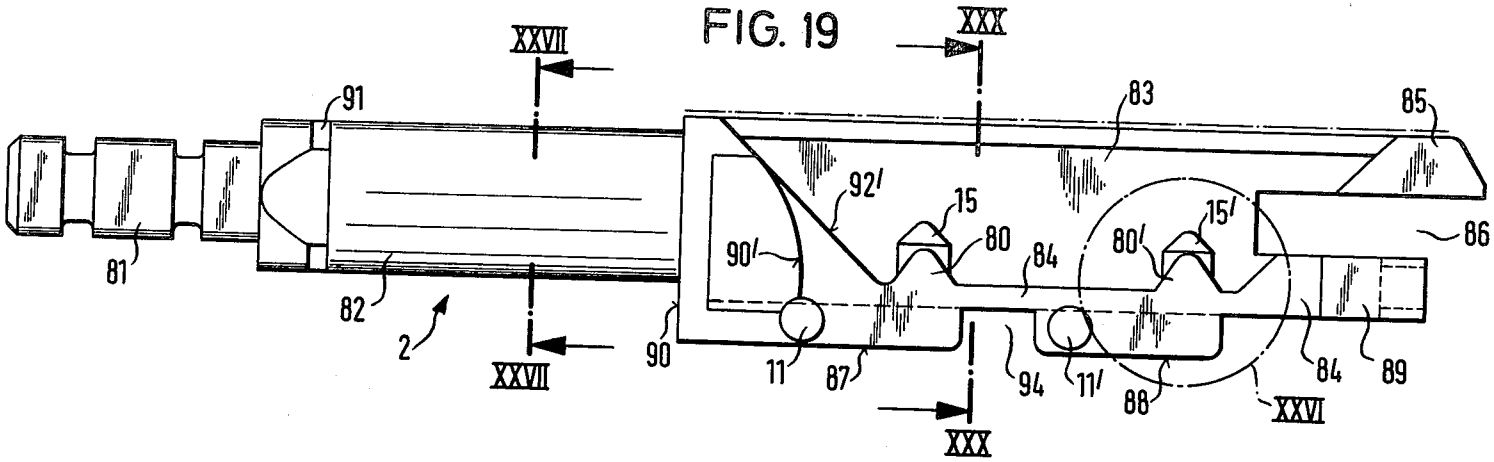
FIG. 19 is a plan view from above of the slide member.
Figure 20:
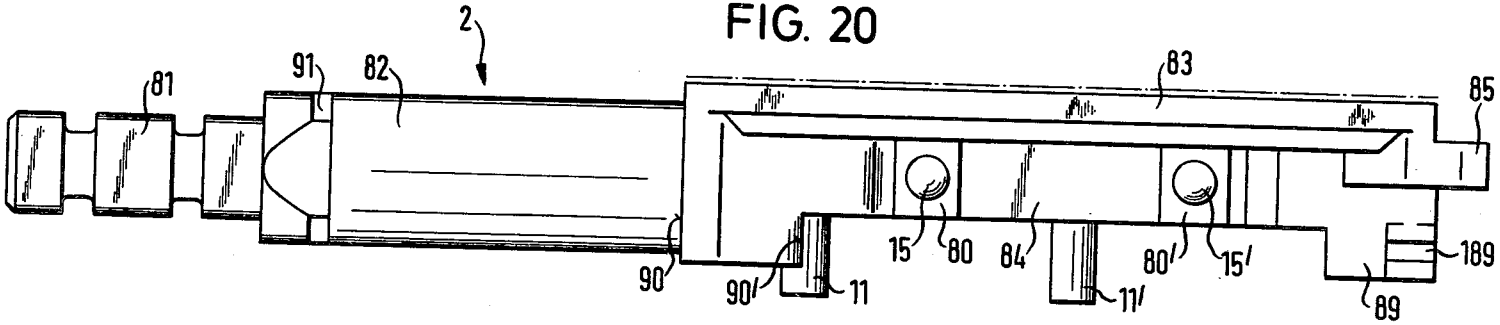
FIG. 20 is a side elevational view of the slide member.
Figure 21:
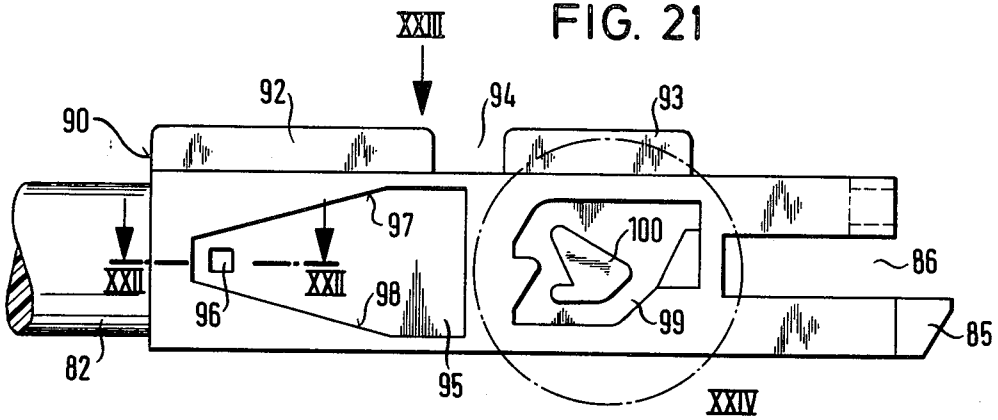
FIG. 21 is a partial view of the underside of the slide member.
Figure 23:
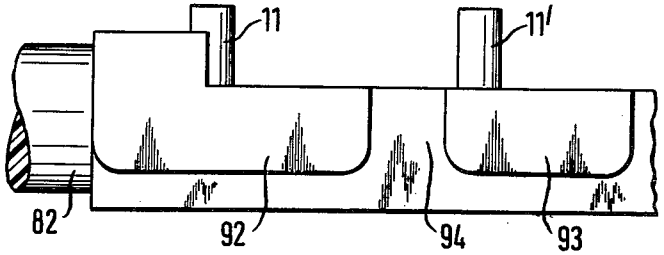
FIG. 23 is a detail view as seen in the direction of arrow XXIII in FIG. 21.
Figure 22:
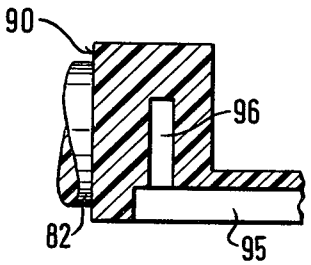
FIG. 22 is a part sectional view along line XXII—XXII FIG. 21.

The transition between the elevation 84 and the wall 90 is made in two steps, as clearly shown by visible edges 92' and 90' (cf. FIGS. 19 and 20).

The elevation 84 is formed with yet another elevation 89 in the area of the recess 86, reaching as far as the full height of the cross section of the wall 90.

The features of the slide member which are important for the invention reside in the space relation between the supporting lugs 15 and 15' and the pins 11 and 11', respectively, whereby the desired cooperation between the spring-action mechanics and the disconnecting mechanics, specifically the desired engagement between the pins 11 and the coordinated stop surfaces of the insulating material levers is guaranteed.

FIG. 21 again clearly shows the arrangement of the projections 92 and 93 (87 and 88 in FIG. 19) carrying the pins 11 and 11', respectively.

Figure 40:
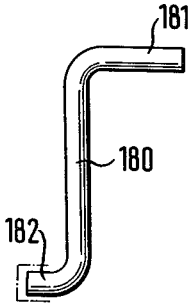
FIG. 40 is a side elevational view of a catch wire.
Figure 41:
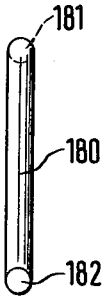
FIG. 41 is a plan view of the catch wire shown in FIG. 40.

Also shown are details of the catch mechanics. To this end a recess 95 is provided at the underside of the plate 83. It may be said generally to be of V-shaped configuration, being defined by sidewalls 97 and 98. In the vicinity of the narrow end of the recess 95 an opening 96 is provided to receive a leg 181 of a catch wire (FIGS. 40 and 41). The long leg 180 of the catch wire is guided in the recess 95 at the plate 83, its pivot range being limited by the sidewalls 97 and 98.

Figure 12:
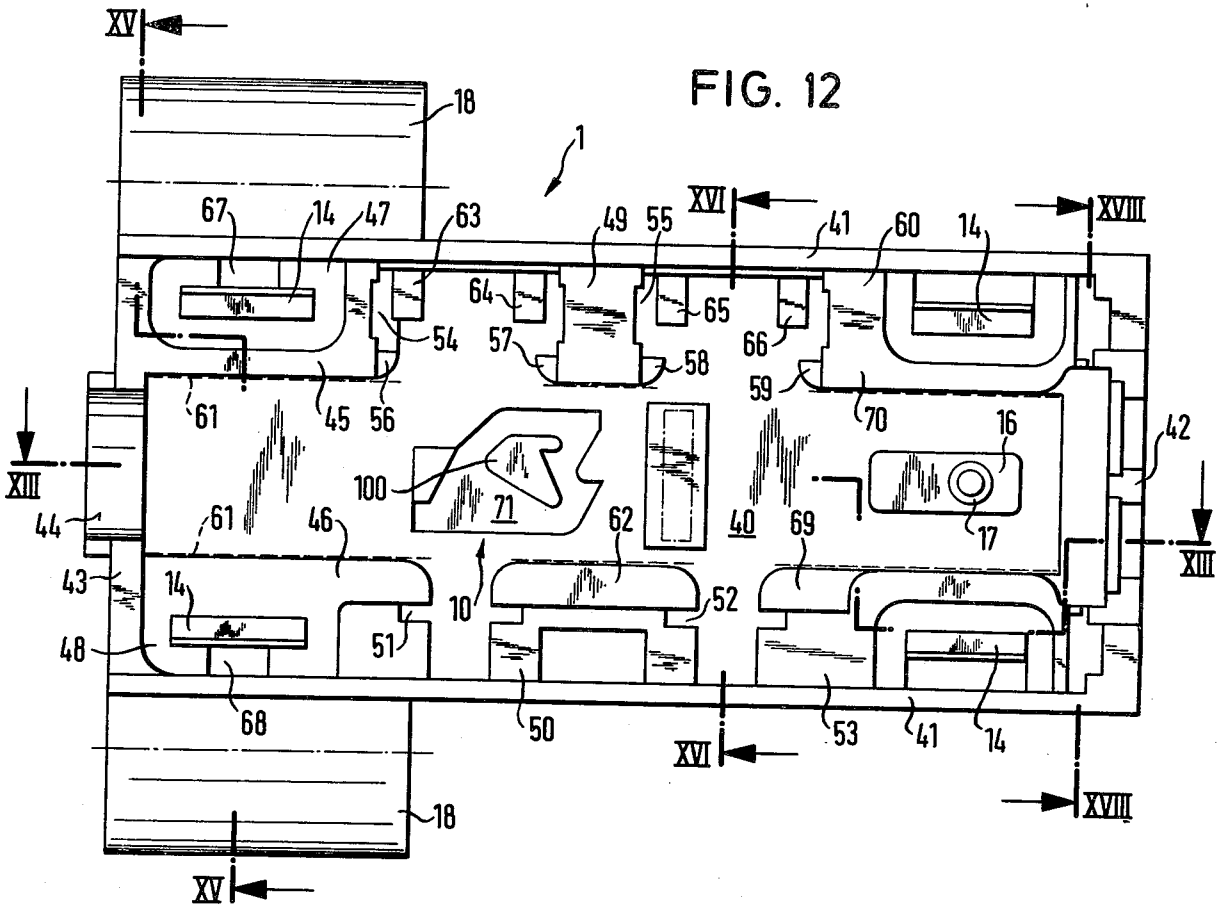
FIG. 12 is a plan view from above of the open housing.

Another recess 99 substantially having the same shape as the recess 71 for the catch mechanics shown in FIG. 12 is located spaced from the recess 95. The explanation below of this catch mechanics given with reference to FIG. 20, therefore, also applies to the corresponding recess 71 of FIG. 12. However, it should be stressed that the recess 71 of the housing is disposed below the recess 95 so that the other leg 182 (FIG. 40 or 41) of the catch wire is guided by the sidewalls of the recess 71 in the bottom of the housing.

Figure 24:
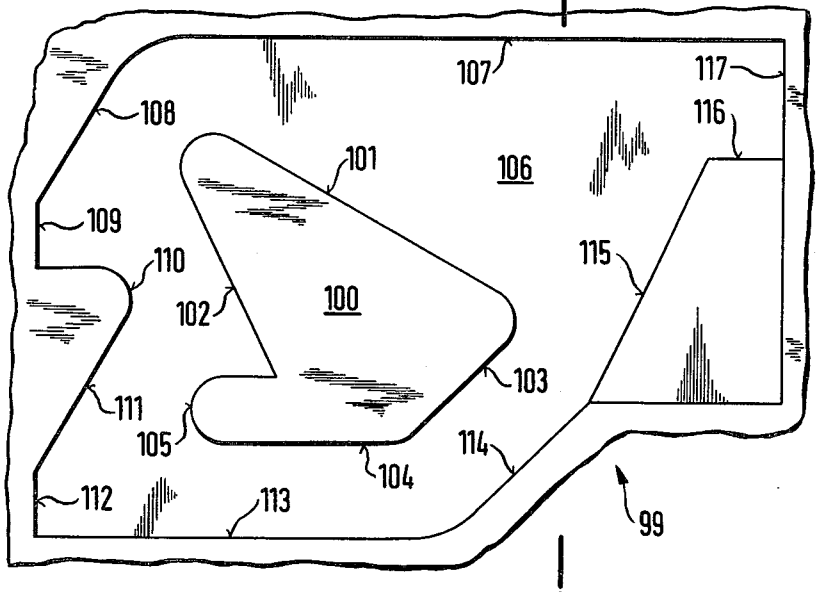
FIG. 24 is a plan view of a detail XXIII in FIG. 21.
Figure 26:
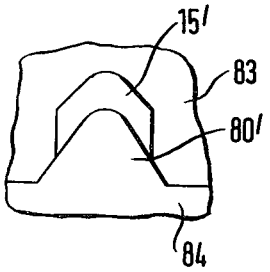
FIG. 26 is an enlarged view of a detail XXVI in FIG. 19.

The guide recesses for the catch wire are shown in greater detail in FIG. 24. Within the recess 99 (FIG. 21) or 106 (FIG. 24) there is an "island" 100. Two sidewalls 101 and 102 of this island 100 extend at an acute angle with respect to each other, being interconnected by a rounded portion. A nose likewise limited by a rounded portion 105 describing an arc of approximately 180° projects almost vertically from the sidewall 102. The adjacent sidewall 104 of the island 100 extends substantially parallel to the longitudinal direction of the slide member or of the housing, merging at an obtuse angle into a sidewall 103 which then merges into the sidewall 101 at an angle which is a little smaller than 90°.

Opposite the sidewall 101 there is a sidewall 107 extending approximately parallel to the longitudinal direction of the slide member or housing. This wall merges by a rounded portion at an obtuse angle of approximately 135° into a sidewall 108 which is located approximately opposite the rounded portion which connects sidewalls 101 and 102. Opposite sidewall 102 the sidewall 108 passes over into a sidewall 109 extending approximately transversely of the longitudinal direction of the slide member or housing. Then a nose 110 projects toward the sidewall 102. The nose 110 merges into an oblique sidewall 111 disposed approximately opposite the nose 105, and then passes over into a short sidewall 112 which again extends transversely of the longitudinal direction of the slide member or housing. From sidewall 112 a sidewall 113 extends parallel to sidewall 107 and consequently opposite and parallel to sidewall 104. This sidewall passes over into a sidewall 114 extending approximately parallel to the sidewall 103. A sidewall 115 follows at an obtuse angle of about 106° to 170°, passing over approximately at the level of the nose which connects sidewalls 101 and 102 into a short section of sidewall 116 extending parallel to sidewall 107. The sidewalls 116 and 107 are connected by way of a sidewall 117 extending in transverse direction.

The leg 182 of the catch wire engages sidewall 117 when the switch is in its one position. If the slide member is displaced, this leg 182 is displaced as well, being guided between the sidewalls 107 and 101 until it abuts against the nose 110 by way of sidewalls 108 and 109. Then the slide member is in its other limit position. If the slide member is slightly moved backwards, the leg 182 abuts against the sidewall 102, where it is guided up to the nose 105. At this constellation the slide member and thus the switch will have adopted the one stationary position. In the embodiment shown, this is with an arrangement of the contacts of FIG. 1 in switch-on position. When the switch is actuated again, the leg slides along the nose 105 until it reaches the sidewall 111 in order to be passed on to the sidewall 112. Then the slide member again has reached its frontmost limit position. Upon release the leg is guided between the sidewalls 113 and 104 or 114 and 103, respectively, sliding along sidewall 115 to the transverse sidewall 117 where the switch will be in its other limit position. In the embodiment shown this is the switchoff position.

Figure 25:
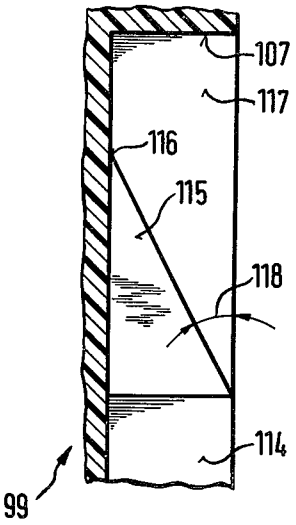
FIG. 25 is a part sectional view along line XXV—XXV in FIG. 24.

It may be gathered from FIG. 25 that the sidewall 115 extends at an angle 118 with respect to the plane defined by the plate 83.

FIGS. 26 to 31 show various sectional elevations or details of the slide member. The configuration of the rib 80 and of the supporting nose 15 specifically may be taken from FIG. 26. The supporting nose 15 substantially has the shape of a spherical segment, of course, being disposed above the plate 83 so that the springs 5 and 5' will be supported all around.

Figure 27:
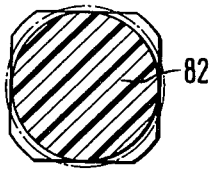
FIG. 27 is a sectional view along line XXVII—XXVII in FIG. 19.
Figure 29:
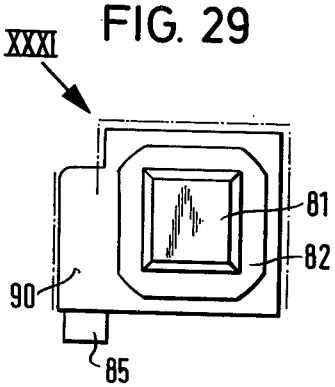
FIG. 29 is a front end view of the slide member as seen from the end projecting out of the housing.

FIG. 27 is a cross sectional view of the plunger 82, while FIG. 29 shows the front side of the pressure key 81 and the outline of the wall 90.

Figure 28:
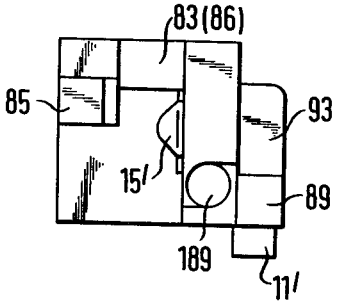
FIG. 28 is a front end view of the slide member as seen from the end inside the switch.

Looking at FIG. 28 means looking at the backside of the plunger. In addition FIG. 28 shows that the projection 89 is formed with a bore 189 into which a spring may be inserted to actuate contacts at the front end side of the housing.

Figure 30:
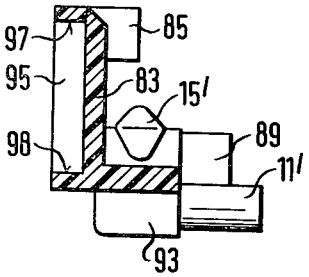
FIG. 30 is a sectional view along line XXX—XXX in FIG. 19.

The sectional elevation of FIG. 30 is another clearer presentation of the recess 95 provided at the underside of the slide member.

Figure 31:
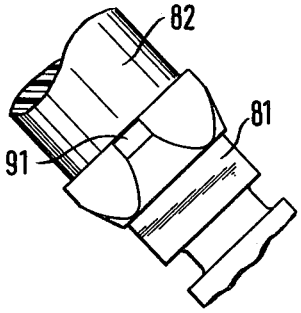
FIG. 31 is a view of the slide member as seen in the direction of arrow XXXI in FIG. 29.

FIG. 31 shows in detail the transition between the pressure key 81 and the plunger 82.

Figure 32:
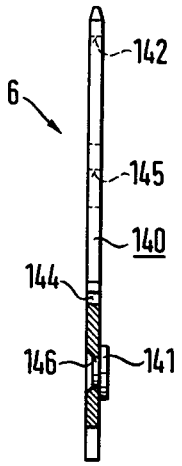
FIG. 32 is a sectional view of a contact eye.
Figure 33:
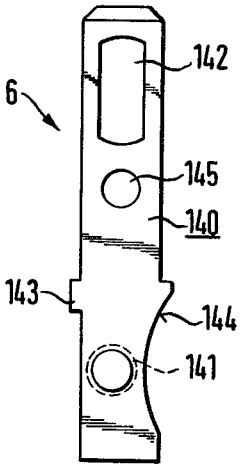
FIG. 33 is a top plan view of a rocking arm.

FIGS. 32 and 33 are more detailed views of the contact eye 6. It consists of a flat piece of metal 140 essentially of rectangular shape and comprising near its one end a contact area 141 which is fixed by riveting in a bore 146. The contact eye is inserted into the housing by way of a nose 143 and a slightly rounded recess 144 provided at the corresponding opposite side. Furthermore, a central bore 145 and a longitudinally extending recess 142 may be provided, the latter serving as a soldering eye.

Figure 34:
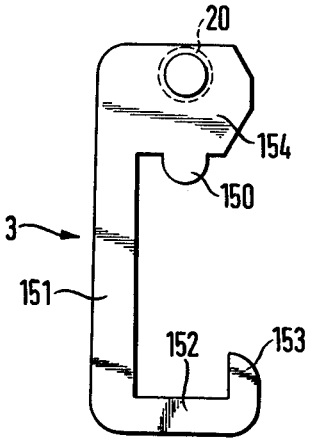
Figure 35:
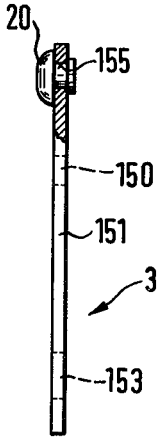
FIG. 35 is a side elevational view, partly in section, of the rocking arm.

FIGS. 34 and 35 show the rocking arm 3 which is likewise made of a flat piece of metal having a shape as follows: An elongated leg 151 passes over into a shorther leg 152 which extends in transverse direction and from which another short leg 153 extends at right angles in upward direction (FIG. 34), thereby being disposed parallel to the leg 151. At the other end of the leg 151 there is a leg 154 extending parallel to the leg 152 and clearly being broader than leg 152. This leg 154 carries the contact area 20 fixed by riveting to a bore 155 provided in this leg 154. The leg 154 further is provided with a nose 150 which projects toward the leg 152 and serves to guide and support the spring 5.

FIGS. 36 and 37 show the support eye 4 for the rocking arm 3. Also the support eye 4 is made of an elongated, flat piece of metal 160 having an enlargement 165 whereby an edge 164 is formed. It is against this edge that the housing closure plate abuts when the switch is in ready assembled state. The lower end of the enlargement 165 is formed with a recess 166. The support eye has another rectangular recess 163 approximately in the middle. The rocking arm is inserted into the support eye in such manner that the leg 153 is guided in the recess 166, whereas the leg 151 is disposed in the recess 163. Leg 152 thus extends parallel to the wall of the enlargement 165. At its upper end the support eye also has an approximately rectangular recess 161 serving as a soldering eye. Furthermore the support eye may have another bore 162 similar to bore 145 of contact eye 6.

Figure 38:
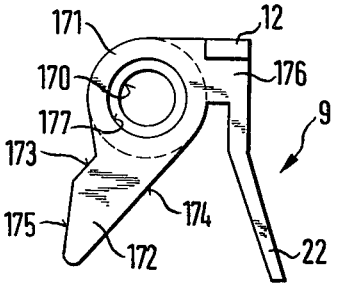
FIG. 38 is a top plan view of the insulating material lever.
Figure 39:
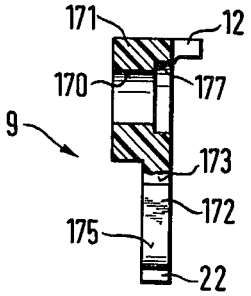
FIG. 39 is a sectional view of the insulating material lever shown in FIG. 38.

FIGS. 38 and 39 show the insulating material lever 9 in greater detail. This insulating lever has a substantially cylindrical basic body 171 provided with a central bore 170. This bore 170 is guided at the outer wall of the bolt 13, whereas the outside of the cylindrical basic body 171 is guided in the recess 28 (FIG. 7) of the housing closure plate. A nose 172 which is narrower than the cylindrical basic body 171 projects from this body. Specifically the width of the nose 172 is adapted to the width of the recess 25 (FIG. 7), while the entire width of the insulating material lever corresponds to the width of the sum of the two recesses 28 and 25.

The nose 172 has two substantially parallel edges 173 and 174 connected to each other by an inclined wall 175.

The two walls 173 and 174 extend at an acute angle with respect to a radius of the bore 170, the wall 174 merging tangentially in the outer circumference of the cylindrical basic body 171.

Wall 173 serves as a stop for pin 11 which may pass along the outer circumference of the cylindrical basic body 171 until it hits against the wall 173.

Approximately opposite the nose 172 the cylindrical basic body 171 is provided with another projection 176 whose thickness corresponds to the thickness of the nose 172. The lug 12 which essentially has the shape of a parallelepiped protrudes vertically from the projection 176 in parallel with the axis of the bore 170. The lug 12 extends into the path of pivoting movement of the rocking arm, pressing the latter out of its contacting position when the insulating lever is rocked. Furthermore the spring arm 22 is formed integral with the projection 176, the spring arm including an acute angle with the nose 172. The entire insulating material lever is a one-piece molded member of plastic material.

FIG. 39 further shows that the bore 170 has an enlarged portion 177 to make room for the calking pin which will hold the insulating material lever firmly connected to the bolt 13. If desired, a washer may be inserted here, such as indicated in FIG. 2.

FIGS. 40 and 41 show the catch wire which is of circular cross section and substantially has S-shaped configuration as seen from the side. Specifically the legs 181 and 182 extend substantially perpendicularly from the central leg 180, each being bent to different sides so that they are disposed antiparallel with respect to each other.

All technical details shown in the claims, specification, and drawings may be essential for the invention, either alone or in any desired combination.

What is claimed is:

1. An electrical slide switch, comprising:

at least one rocking arm which is pivotable by a slide member and spring-action mechanics and touches a contact at least in its one pivoting end position; and disconnecting means for positive separation of the rocking arm from its associated contact upon opening of the slide switch, said disconnecting means comprising a pivotable insulating material lever means for pivoting by said slide member and acting upon the rocking arm in the sense of separating the same from its said associated contact as the slide member is moved, said insulating material lever means action on the rocking arm shortly before the slide member reaches its end position, wherein said insulating material lever means is biased resiliently in one direction in which it is out of engagement with the rocking arm, and said insulating material lever means is supported at a housing closure plate on a pivot designed as a bolt, a lug projecting into the path of pivoting movement of the rocking arm being engageable with the rocking arm and a pin projecting out of the slide member being pushed against an abutement face of the insulating material lever means so as to pivot the same upon movement of the slide member.

2. The switch as claimed in claim 1, wherein the insulating material lever means comprises a spring arm which is integrally connected to the lever means and supported against a support face of the housing closure plate.

3. The switch as claimed in claim 2, wherein the insulating material lever means is held in a recess of the housing closure plate on said pivot bearing designed as a bolt, the lug alone projecting out of the recess.

4. The switch as claimed in claim 3, wherein a calking pin is provided at the end of the bolt.

5. The switch as claimed in claim 3, wherein the insulating material lever means is supported on the bolt and, additionally, at a circular recess of the housing closure plate.

6. The switch as claimed in claim 5, further comprising additional rocking arms and associated contacts, wherein each rocking arm is coordinated with an insulating material lever means of its own.

* * * * *